US006720945B1

(12) United States Patent
Takeda et al.

(10) Patent No.: US 6,720,945 B1
(45) Date of Patent: Apr. 13, 2004

(54) LIQUID CRYSTAL DISPLAY DEVICE HAVING A VIDEO CORRECTION SIGNAL GENERATOR

(75) Inventors: Hiroshi Takeda, Tokyo (JP); Shinji Kiyomatsu, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 124 days.

(21) Appl. No.: 09/649,488

(22) Filed: Aug. 28, 2000

(30) Foreign Application Priority Data

Aug. 30, 1999 (JP) ..... 11-244019

(51) Int. Cl.[7] ..... G09G 3/36
(52) U.S. Cl. ..... 345/87; 345/100
(58) Field of Search ..... 345/87, 90, 91, 345/92, 94, 95, 96, 97, 100, 103; 349/41, 42, 33, 54

(56) References Cited

U.S. PATENT DOCUMENTS 5,457,474 A * 10/1995 Ikeda ..... 345/103
6,222,516 B1 * 4/2001 Oda ..... 345/94
6,259,425 B1 * 7/2001 Shimizu ..... 345/100
6,331,844 B1 * 12/2001 Okumura et al. ..... 345/100

FOREIGN PATENT DOCUMENTS

JP 3-132721 6/1991
JP 10-274762 10/1998
JP 10-274967 10/1998

* cited by examiner

*Primary Examiner*—Chanh Nguyen
(74) *Attorney, Agent, or Firm*—Choate, Hall & Stewart

(57) ABSTRACT

A liquid crystal display device includes a plurality of pixels arranged in a matrix, a drain line provided for each column of the plurality of pixels, a gate line provided for each row of the plurality of pixels, and an output buffer to output a video signal supplied to the drain line. Also provided is a video correction signal generator to superpose a correction signal on the output signal of the output buffer.

12 Claims, 9 Drawing Sheets

LIQUID CRYSTAL DISPLAY DEVICE HAVING A VIDEO CORRECTION SIGNAL GENERATOR

BACKGROUND OF THE INVENTION

1. Field of the Invention

The present invention relates to liquid crystal display devices such as active matrix type devices including a plurality of thin film transistors. The invention more particularly relates to a liquid crystal display device which can prevent variations in video images such as a drop in the brightness caused by rounding of the waveform of video signals.

2. Description of the Related Art

In conventional active matrix type liquid crystal display devices, there is a source driver to drive a thin film transistor provided on a one-pixel-basis. FIG. 1 is a circuit diagram of the configuration of a conventional liquid crystal display device. In the conventional liquid crystal display device, a thin film transistor is provided for each of the pixels arranged in a matrix. A plurality of thin film transistors TL1, . . . , Tm1, Tn1, . . . forming the first column have their drains connected in common to a drain line D1. Similarly, a plurality of thin film transistors T12, . . . , Tm2, . . . , Tn2, . . . forming the second column have their drains connected in common to a drain line D2. Thus, a plurality of thin film transistors T1*a*, . . . , Tma, . . . , Tna, . . . forming the a-th column have their drains connected in common to a drain line Da.

The drain lines are connected with output buffers B1, B2, B3, B4, . . . provided at a source driver 11.

A plurality of thin film transistors T11, T12, T13, T14, . . . forming the first row have their gates connected in common to a gate line G1. Similarly, a plurality of thin film transistors Tm1, Tm2, Tm3, Tm4, . . . forming the m-th row have their gates connected in common to a gate line Gm, and a plurality of thin film transistors Tn1, Tn2, Tn3, Tn4, . . . forming the n-th row have their gates connected in common to a gate line Gn. Thus, a plurality of thin film transistors Tb1, Tb2, Tb3, Tb4, . . . forming the b-th row have their gates connected in common to a gate line Gb.

In the conventional liquid crystal display device having the above-described configuration, a video signal is supplied from the output buffers B1, B2, to the drain lines D1, D2, respectively. The gate lines G1, . . . , Gm, . . . , Gn, . . . are supplied with a control signal from a vertical driver (not shown), and each thin film transistor turns on/off in response to the control signal. When the thin film transistor is turned on, the video signal supplied to the corresponding drain line is applied to the liquid crystal for the pixel, so that a video image based on the video signal is displayed on the display.

In the conventional display device described above, however, there are resistance and capacitance parasitic in the drain line, and its time constant increases from the input end on the output buffer side to the terminal end on the opposite side. As a result, the video signal is rounded in the waveform. More specifically, as shown in FIG. 1, when one vide signal is output from the output buffer B1 to the drain line D1, he thin film transistor T11 connected to the gate line G1 in the first row is provided with a normal square signal, but the thin film transistor Tm1 connected to the gate line Gm in the m-th row is provided with a signal having a rounded waveform. Furthermore, the thin film transistor Tn1 connected to the gate line Gn in the n-th row provided farther from the output buffer B1 is provided with a signal having a more rounded waveform. When the distance from the output buffer B1 exceeds a prescribed value, the wave height at the time of falling is lower than a prescribed level.

A pixel stores a signal voltage at the time of falling of the signal, and therefore if the value decreases, the luminance changes, which causes variations in video images. If, for example, an image in white is to be displayed on the entire display screen, the brightness decreases as the distance from the output buffer increases.

Therefore, in order to prevent such variations in video images depending on the distance from the source driver, a liquid crystal display device which outputs a video signal from both sides of the drain line has been suggested (Japanese Patent Laid-Open Publication No. 10-274762).

The conventional liquid crystal display device disclosed in this publication could reduce variations in video images compared to the devices before then, but the disadvantage associated with the waveform rounding is not solved. In the central part of the drain line, there exist video image variations. In addition, this technique requires two drivers in some cases, and therefore should not be considered sufficient in terms of reduction in the area and the cost.

SUMMARY OF THE INVENTION

It is an object of the present invention to provide a liquid crystal display device which can prevent video image variations caused by parasitic resistance and parasitic capacitance in a drain line.

A liquid crystal display device according to the present invention comprises a plurality of pixels arranged in a matrix, a drain line provided for each column of the plurality of pixels, a gate line provided for each row of the plurality of pixels, an output buffer to output a vide signal to be supplied to the drain line, and a video correction signal generator to superpose a correction signal on the output signal of the output buffer.

According to the present invention, the video correction signal generator superposes a correction signal on the output signal of the output buffer, so that even with waveform rounding caused by parasitic resistance and capacitance in the drain line, the wave height of a video signal at the time of falling can be appropriately adjusted when the signal is supplied to a desired pixel. As a result, video image variations can be prevented.

The pixel may include a thin film transistor having a drain connected to the drain line and a resistive element connected in series to the source of the thin film transistor. The resistance value of the resistive element is desirably reduced as the length of the drain line between the pixel and the video correction signal generator is increased. If a resistive element having a prescribed resistance value is connected in series to the source of the thin film transistor, voltage applied to the liquid crystal can be appropriately adjusted even if a large video signal is input to the pixel.

The video correction signal generator may include a differentiator to differentiate the output signal of each of the output buffers and an adder to add the output signal of each of the differentiators and the output signal of each of the output buffers, and may output the output signal of each of the adders to a corresponding one of the drain lines. Alternatively, the video correction signal generator may include a differentiator to differentiate an externally input reference pulse, and an adder to add the output signal of the differentiator and the output signal of each of the output buffers, and may output the output signal of each of the adders to a corresponding one of the drain lines.

The differentiator may generate a signal having a suitable peak at least in one of the rising and falling of the output signal of the output buffer or the reference pulse. If the differentiator is shared among drain lines, the area occupied by the circuit may be reduced.

It should be noted that the video correction signal generator described above desirably has a correction signal changing system to change a waveform of the correction signal in association with the length of the drain line between the pixel to be supplied with the video signal and itself.

The video correction signal generator is thus provided with the correction signal changing system so that a video signal suitable for a pixel provided for each gate line can be provided depending upon the resistance and capacitance parasitic in the drain line.

The video correction signal generator may include a differentiator to differentiate the output signal of the output buffer, an integrator to integrate the output signal of the differentiator and output the result of integration in association with an input first disenable signal, an inverting integrator to invert and integrate the output signal of the differentiator and output the result of integration in association with an input second disenable signal, a first adder to add the output signal of the integrator and the output signal of the inverting integrator, and a second adder to add the output signal of the first adder and the output signal of the output buffer.

The video correction signal generator may also include a differentiator to differentiate an externally input reference pulse, an integrator to integrate the output signal of the differentiator and output the result of integration in association with an input first disenable signal, an inverting integrator to invert and integrate the output signal of the differentiator and output the result of integration in association with an input second disenable signal, a first adder to add the output signal of the integrator and the output signal of the inverting integrator, and a second adder to add the output signal of the first adder and the output signal of the output buffer.

If such differentiators and integrators are shared among drains, the area occupied by the circuit may be reduced.

The nature, principle, and utility of the invention will become more apparent from the following detailed description when read in conjunction with the accompanying drawings in which like parts are designated by like reference numerals.

DETAILED DESCRIPTION OF THE PREFERRED EMBODIMENT

Figure 2:
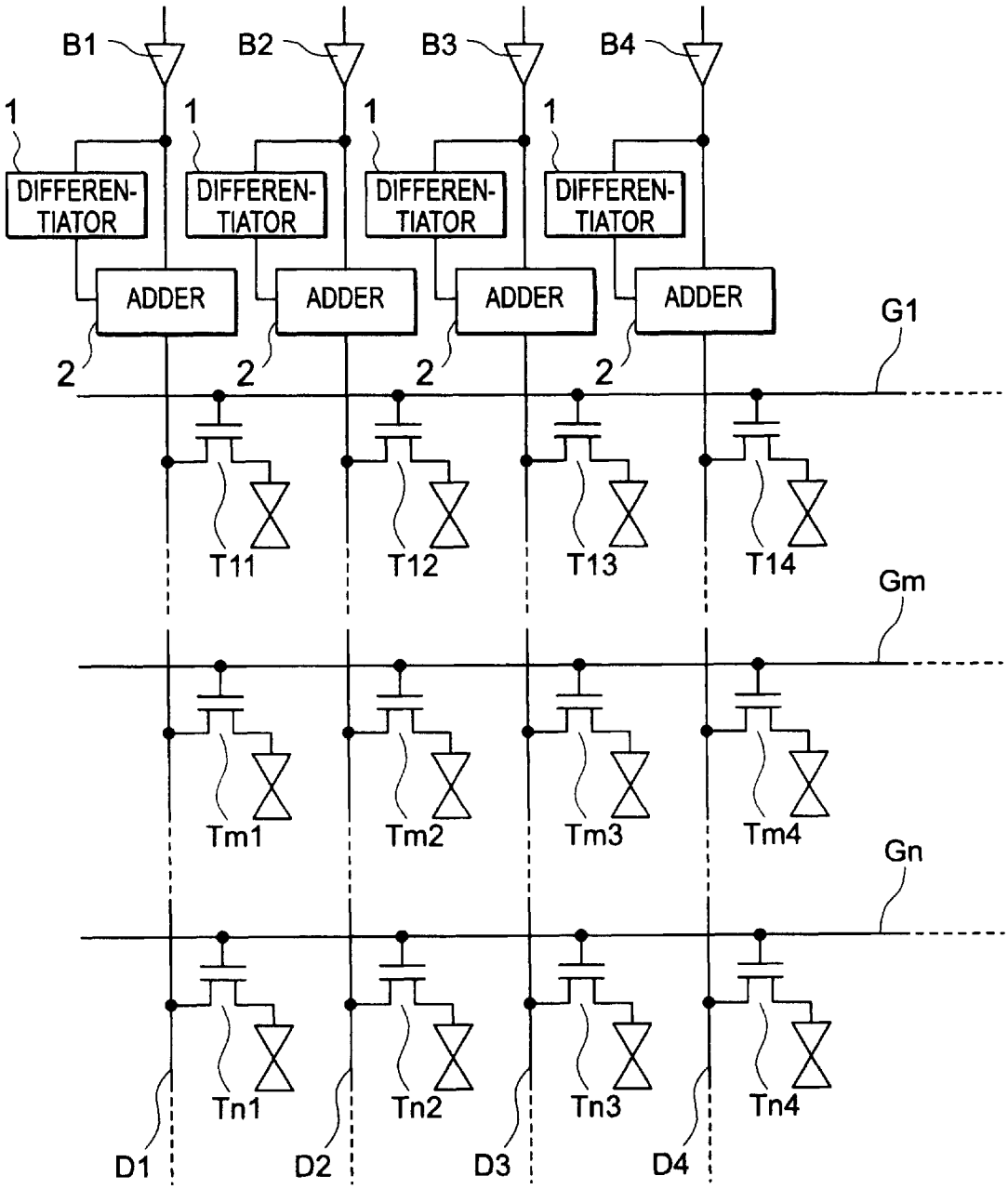
FIG. 2 is a block diagram of the configuration of a liquid crystal display device according to a first embodiment of the present invention.
Figure 3:
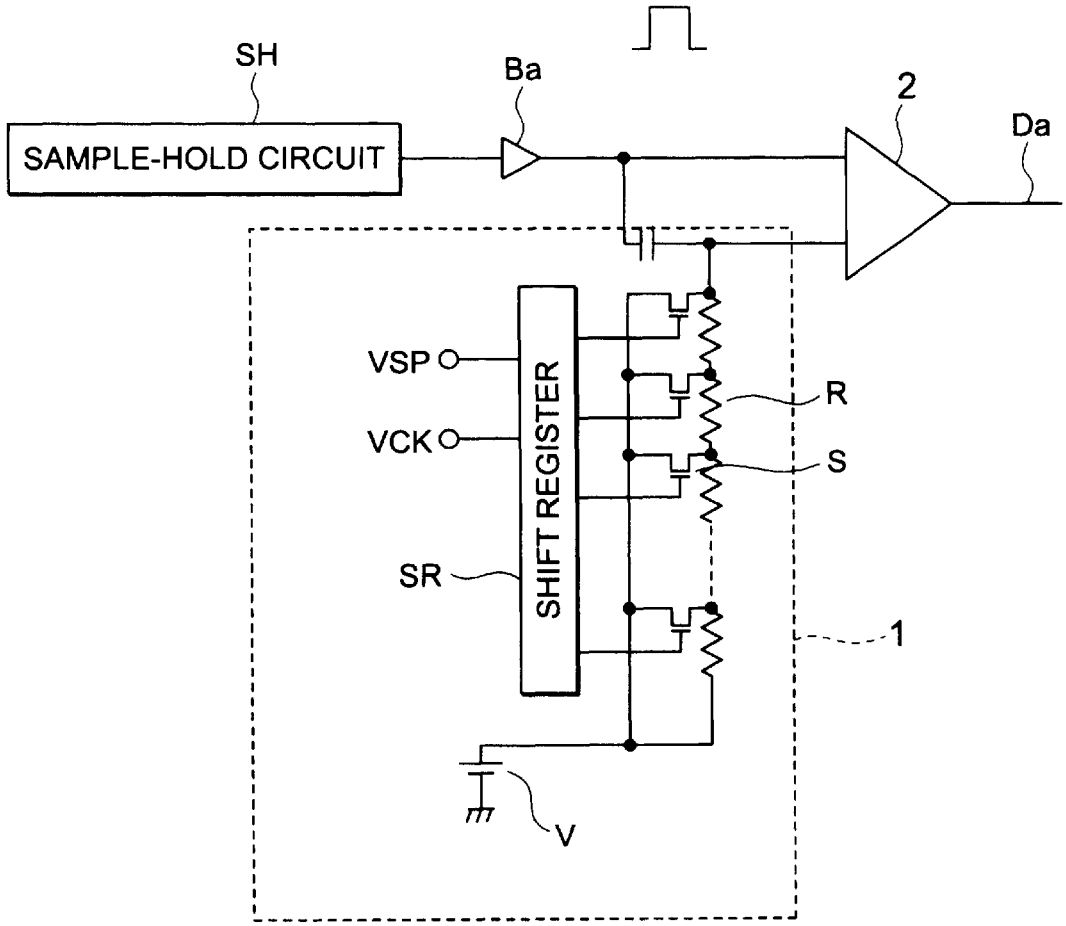
FIG. 3 is a circuit diagram of a specific configuration of the differentiator 1 in FIG. 2.

Liquid crystal display devices according to embodiments of the present invention will be now described in detail in conjunction with the accompanying drawings. FIG. 2 is a block diagram of the configuration of a liquid crystal display device according to a first embodiment of the present invention. FIG. 3 is a circuit diagram of a specific configuration of the differentiator 1 shown in FIG. 2.

In the first embodiment, as shown in FIG. 2, a thin film transistor is provided for each of the pixels arranged in a matrix. A plurality of thin film transistors T11, . . . , Tm1, . . . , Tn1, . . . forming the first column have their drains connected in common to a drain line D1. Similarly, a plurality of thin film transistors T12, . . . , Tm2, . . . , Tn2, . . . forming the second column have their drains connected in common to a drain line D2. A plurality of thin film transistors T13, . . . , Tm3, . . . , Tn3, . . . forming the third column have their drains connected in common to a drain line D3. A plurality of thin film transistors T14, . . . , Tm4, . . . , Tn4, . . . forming the fourth column have their drains connected in common to a drain line D4. Thus, a plurality of thin film transistors T1*a*, . . . , Tma, . . . , Tna, . . . forming the a-th column have their drains connected in common to a drain line Da.

A plurality of thin film transistors T11, T12, T13, T14, . . . forming the first row have their gates connected in common to a gate line G1. Similarly, a plurality of thin film transistors Tm1, Tm2, Tm3, Tm4 , . . . forming the m-th row have their gates connected in common to a gate line Gm, and a plurality of thin film transistors Tn1, Tn2, Tn3, Tn4, . . . forming the n-th row have their gates connected in common to a gate line Gn. Thus, a plurality of thin film transistors Tb1, Tb2, Tb3, Tb4, . . . forming the b-th row have their gates connected in common to a gate line Gb.

An adder 2 is connected to each of the drain lines. The adder 2 has an input end connected to any of the output buffers B1, B2, B3, B4, . . . and to the output end of the differentiator 1. The differentiator 1 has its input end connected to any of the output ends of the output buffers B1, B2, B3, B4, . . . . An output signal from each adder 2 is supplied to a thin film transistor connected to each drain line. In the first embodiment, the differentiator 1 and the adder 2 constitute a video correction signal generator.

The differentiator 1 is provided with a capacitive element C connected between an output buffer Ba and the adder 2 as shown in FIG. 3. There is also provided a DC power supply V to supply common voltage, i.e., intermediate voltage for voltage applied to the liquid crystal. A plurality of resistive elements R are connected in series to one another between the DC power supply V and the capacitive element C on the side of the adder 2. A switch element S formed of a transistor for example is connected each between the resistive elements R and to the resistive element R at the nearest position to the capacitive element C on its capacitive element C side. The other end of the switch element S is connected to the DC power supply V, and there is provided a shift register SR to switch on/off the switch element S.

Note that as shown in FIG. 3, a sample-hold circuit SH is connected to the input end of each output buffer Ba.

Using the shift register SR, a plurality of switch elements S are turned on/off based on a clock signal VCK and a shift pulse VSP. More specifically, the longer the length of the drain line between a pixel to be provided with a video signal as an input and the output buffer Ba, the larger will be the number of switch elements S to be turned off so that the amount of differentiation increases.

Figure 4:
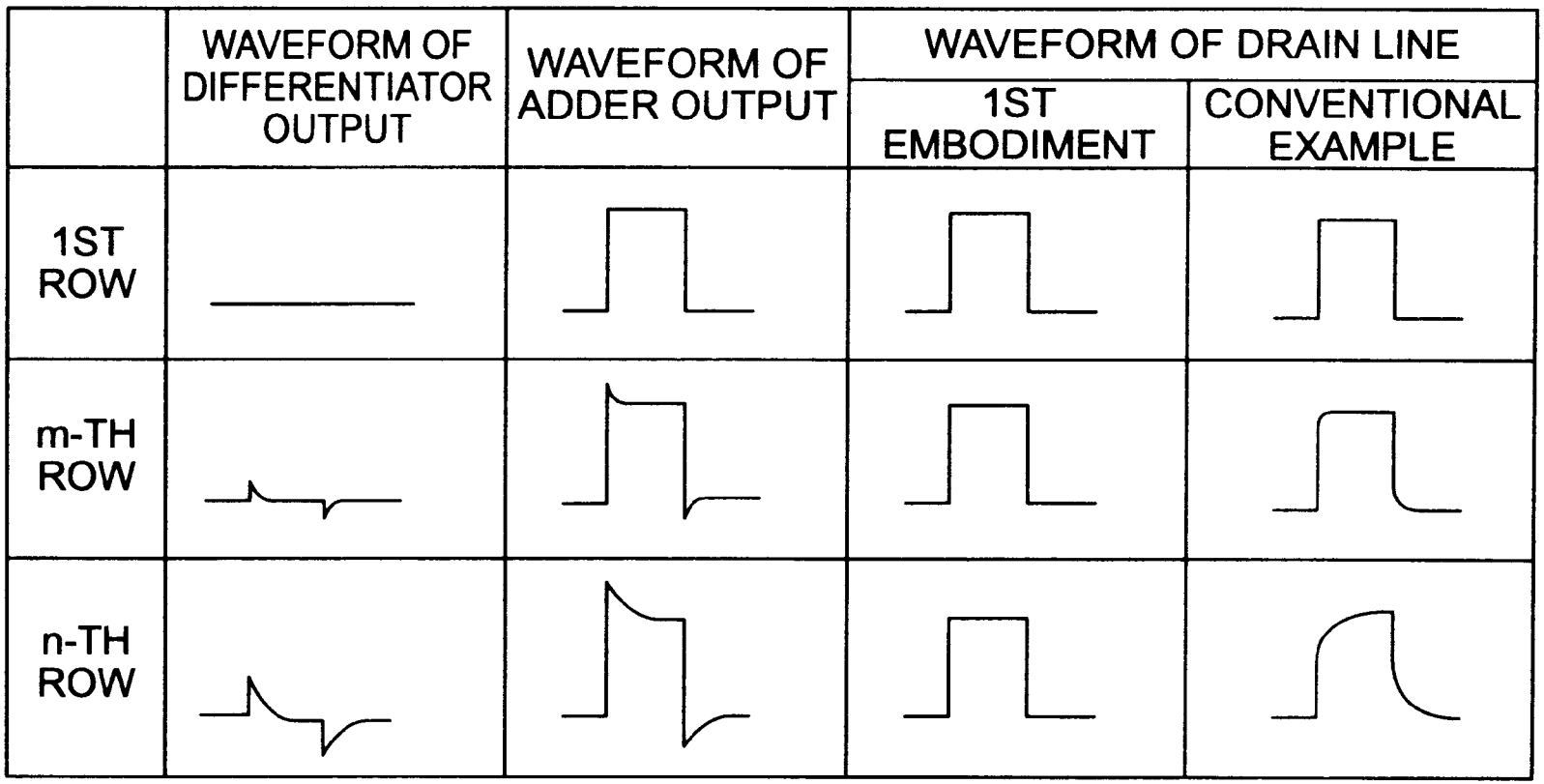
FIG. 4 is a table of waveforms for use in illustration of the operation of the liquid crystal display device according to the first embodiment of the present invention.

The operation of the liquid crystal display device according to the first embodiment having the above-described configuration will be now described. FIG. 4 is a table of waveforms for use in illustration of the operation of the liquid crystal display device according to the first embodiment of the present invention. For the purpose of comparison, FIG. 4 also shows the waveform in a drain line in the conventional liquid crystal display device shown in FIG. 1.

Upon input of a video signal from the sample-hold circuit SH to the output buffers B1, B2, B3, B4, . . . , the output buffers B1, B2, B3, B4, . . . each output the video signal. The video signal output from each of the output buffers B1, B2, B3, B4, . . . is input to the differentiator 1 and the adder 2. If for example the thin film transistors T11, T12, T13, T14, . . . connected to the gate line G1 in the first row are to be driven, all the switch elements S are turned on in the differentiator 1 and no differentiation is executed. The signal output from the adder 2 is therefore the same as the video signal output from the output buffers B1, . . . . Note however that in this case, since the length of the drain lines D1, D2, D3, D4, . . . between the gate line G1 and the output buffers B1, . . . is short, no rounding is caused in the waveform before a signal is supplied to the thin film transistors. As a result, as shown in FIG. 4, a normal waveform is input to each pixel through the thin film transistors T11, T12, . . . connected to the gate line G1.

Meanwhile, when the thin film transistors Tm1, Tm2, Tm3, Tm4, connected to the gate line Gm in the m-th row are to be driven, in the differentiator 1, a plurality of switch elements S from the side of the capacitive element C are turned off and a prescribed amount of differentiation is executed. As a result, the output waveform of the differentiator 1 is a waveform produced by adding a signal having some peak at the rising and falling of the video signal to that video signal as shown in FIG. 4. Therefore, the signal output from the adder 2 is a signal produced by adding a signal having some peak to the video signal output from the output buffer B1, . . . . The signal is then output to the drain line, and the waveform is to be rounded by the resistance and capacitance parasitic in the gate line Gm before the signal reaches the thin film transistors Tm1, . . . connected to the gate line Gm. As a result, when a video signal is supplied to these thin film transistors Tm1, . . . , the waveform is returned to the normal waveform as shown in FIG. 4. Then the normal waveform is input to each pixel through the thin film transistors Tm1, Tm2, . . . connected to the gate line Gm.

When the thin film transistors Tn1, Tn2, Tn3, Tn4, . . . connected to the gate line Gn in the n-th row are to be driven, in the differentiator 1, a plurality of switch elements S on the side of the capacitive element C are turned off, and a prescribed amount of differentiation is executed. In this case, the number of the switch elements S to be turned off is larger than that in the case of the gate line Gm in the m-th row. As a result, the output waveform of the differentiator 1 attains a waveform produced by adding a signal having a peak higher than that in the case of the gate line Gm in the m-th row to the rising and falling of the video signal as shown in FIG. 4. The signal output from the adder 2 is therefore a signal produced by adding a signal having a higher peak to the video signal output from the output buffers B1, . . . . The signal is then output to the drain line, and has its waveform rounded by the resistance and capacitance parasitic in the gate line Gn before the signal reaches the thin film transistors Tn1, . . . connected to the gate line Gn. The gate line Gn is at a position farther from the output buffer Ba than the gate line Gm, and therefore the degree of rounding is greater. As a result, when a video signal is supplied to the thin film transistors Tn1, . . . , the waveform is returned to the normal waveform as shown in FIG. 4. The normal waveform is input to each pixel through the thin film transistors Tn1, Tn2, . . . connected to the gate line Gn.

Thus, according to this embodiment, the amount of differentiation executed by the differentiator 1 is adjusted based on a gate line to which a thin film transistor to be supplied with a video signal is connected. Then, the output signal of the differentiator 1 and the output signal of the output buffer Ba are added by the adder 2 for output to the drain line. As a result, a desired waveform is attained before the video signal reaches a prescribed thin film transistor. This prevents variations in video images, and an image having a desired luminance may be obtained regardless of the distance between the pixel and the output buffer.

Figure 5:
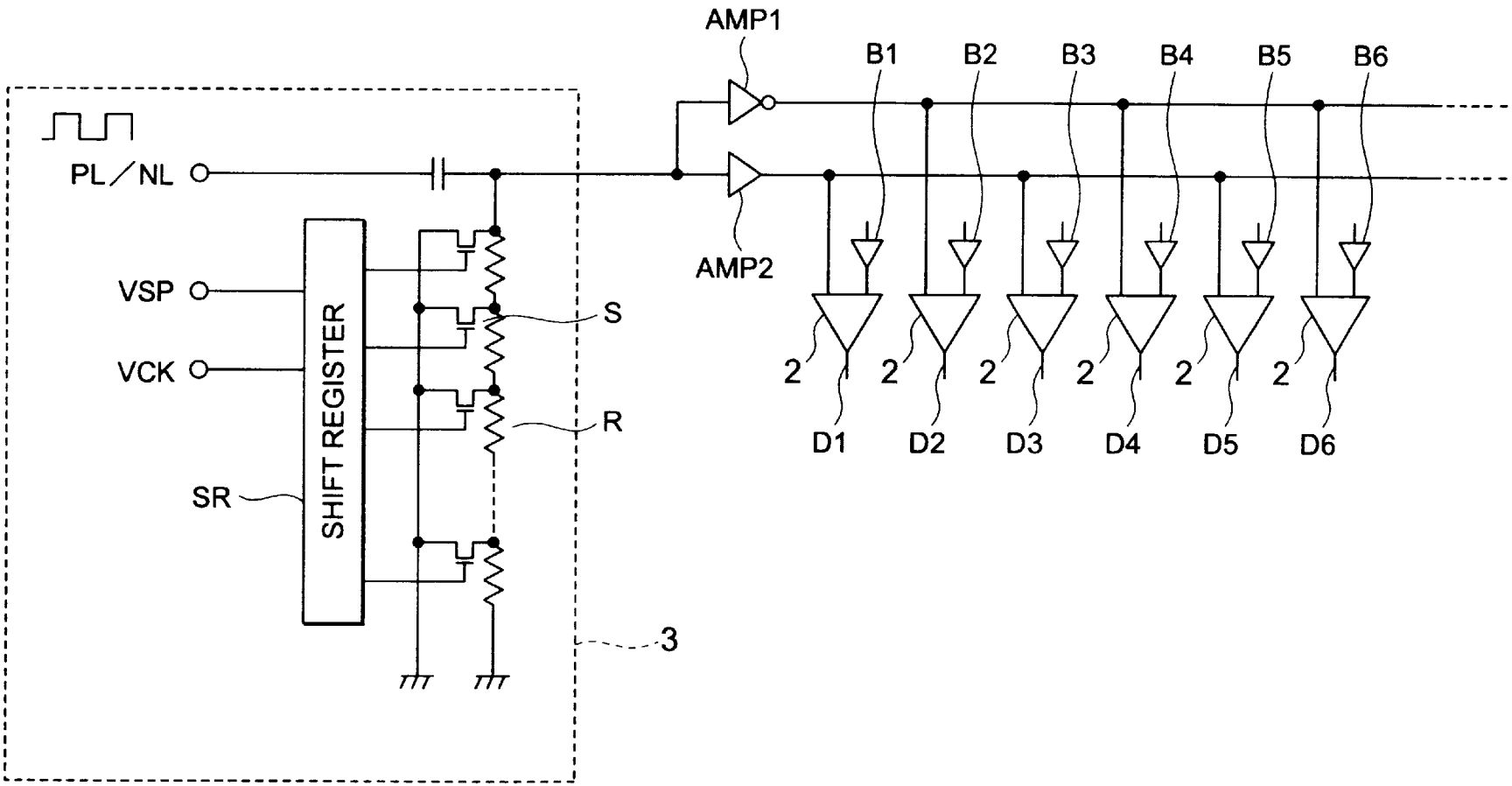
FIG. 5 is a block diagram of the configuration of a liquid crystal display device according to a second embodiment of the present invention.

A second embodiment of the present invention will be now described. In the first embodiment, the differentiator 1 and the adder 2 are provided for each drain line, but the operation thereof is common among the drain lines, and therefore a differentiator may be shared among drain lines. In the second embodiment, a dif ferentiator is shared among drain lines. Note that the second embodiment is achieved by a dot inversion type, liquid crystal display device. FIG. 5 is a block diagram of the configuration of the liquid crystal display device according to the second embodiment of the present invention. In the second embodiment shown in FIG. 5, the same elements as those in the first embodiment shown in FIGS. 2 and 3 are denoted by the same reference characters and a detailed description thereof is not provided.

In the second embodiment, there is a differentiator 3 provided with a polarity inversion signal PL/NL as a reference signal rather than the output signal of an output buffer. In the differentiator 3, a ground potential is supplied instead of the common voltage in the first embodiment. Note that the differentiator 3 has an output end connected to an inverting amplifier AMP1 and a non-inverting amplifier AMP2. The gains of the inverting amplifier AMP1 and the non-inverting amplifier AMP2 are equal.

Drain lines D1, D2, D3, D4, D5, D6, . . . are each connected to the output end of an adder 2 similarly to the first embodiment. The adders 2 have their respective one input ends connected to output buffers B1, B2, B3, B4, B5, B6, . . . each connected to a sample-hold circuit (not shown). The adders 2 have the other input ends alternately connected to the non-inverting amplifier AMP2 and the inverting amplifier AMP1 from the first column. In the second embodiment, the differentiator 3, the adder 2, the inverting amplifier AMP1 and the non-inverting amplifier AMP2 constitute a video correction signal generator.

The operation of the liquid crystal display device according to the second embodiment having the above-described configuration will be now described.

A shift register SR turns on/off a plurality of switch elements S depending on the position of a gate line to which a thin film transistor to be driven based on a clock signal VCK and a shift pulse VSP is connected. A specific operation thereof is the same as that of the first embodiment, and therefore no description is provided here. As a result, the polarity inversion signal PL/NL is subjected to differentiation, and a resulting signal is input to the inverting amplifier AMP1 and the non-inverting amplifier AMP2. The size of the signal input to the inverting amplifier AMP1 and the non-inverting amplifier AMP2 is larger as the position of the gate line is farther from the output buffer.

The inverting amplifier AMP1 then amplifies an input signal with a prescribed gain, and inverts the polarity for output. Meanwhile, the non-inverting amplifier AMP2 amplifies an input signal with a prescribed gain for output.

A signal output from the inverting amplifier AMP1 is input to the adders 2 arranged in even columns, while a signal output from the non-inverting amplifier AMP2 is input to the adders 2 arranged in odd columns. The adders 2 are each provided with a video signal as an input from output buffers B1, . . . A signal resulting from adding a differential signal by the differentiator 3 to the video signal is output to the drain lines D1, D3, D5, . . . from the adders 2 arranged in the odd columns. A signal resulting from adding the inverse of a differential signal by the differentiator 3 to the video signal is output to the drain lines D2, D4, D6, . . . from the adders 2 arranged in the even columns.

The waveform of the signals output to the drain lines D1, . . . from the adders 2 is rounded by the resistance and capacitance parasitic in the drain lines, so that a normal waveform is attained when the signal reaches a thin film transistor connected to a prescribed gate line. The normal waveform is input to each pixel through the thin film transistor connected to the gate line.

Thus, according to the second embodiment, similarly to the first embodiment, a video signal attains a desired waveform when it reaches a prescribed thin film transistor. This prevents variations in video images, and an image with a desired luminance may be obtained regardless of the distance between the pixel and the output buffer. Since the dif ferentiator 3 is shared among the drain lines, the area occupied by the video correction signal generator may be smaller than that in the first embodiment.

Figure 6:
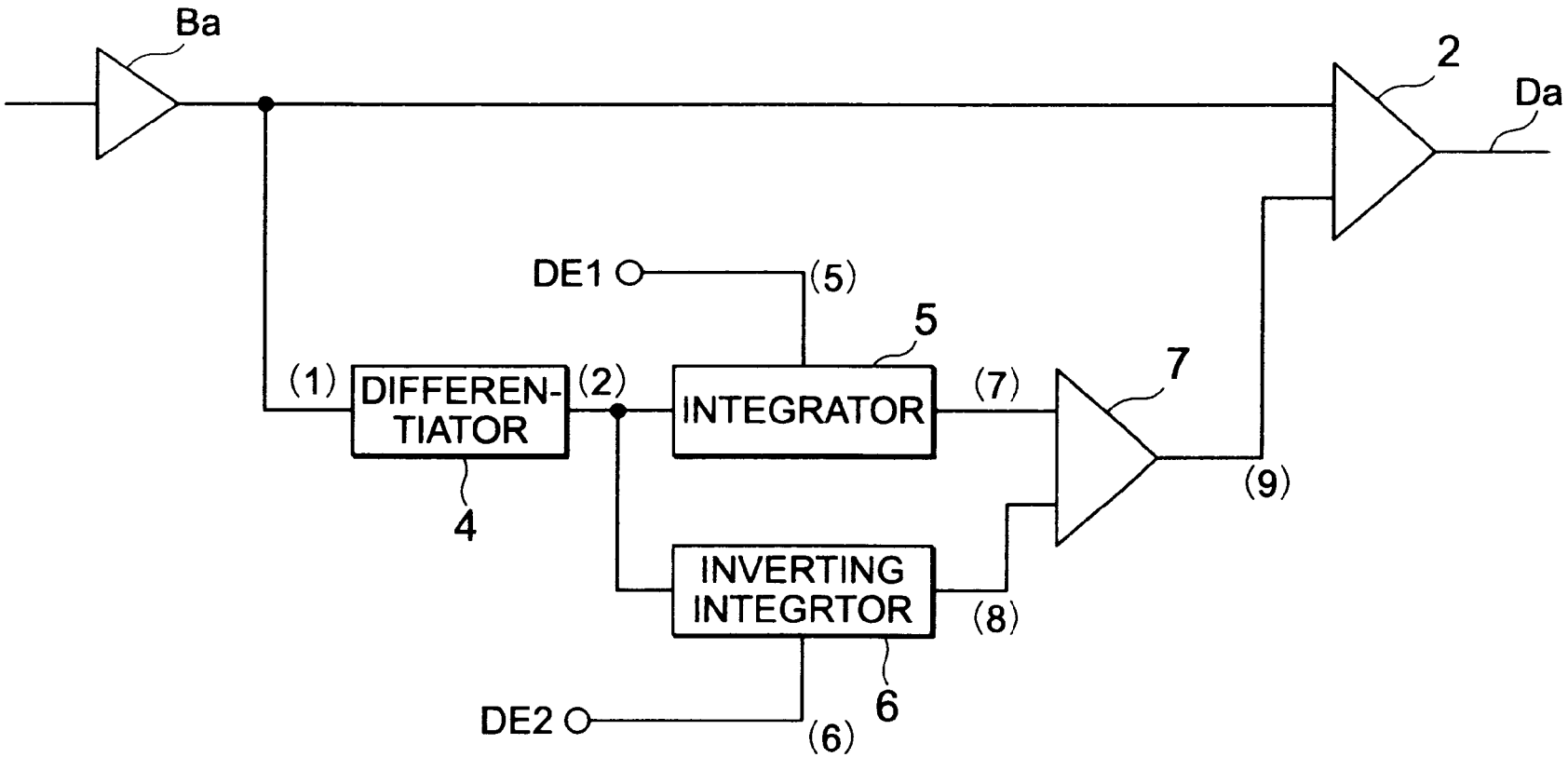
FIG. 6 is a block diagram of the configuration of a liquid crystal display device according to a third embodiment of the present invention.

A third embodiment of the present invention will be now described. In the third embodiment, the arrangement between the output buffer and the adder is different from that in the first embodiment. FIG. 6 is a block diagram of the configuration of a liquid crystal display device according to the third embodiment of the present invention. Note that in the third embodiment shown in FIG. 6, the same elements as those in the first embodiment shown in FIGS. 2 and 3 are denoted by the same reference characters and a detailed description thereof is not provided.

In the third embodiment, the output buffer Ba has its output end connected to a dif ferentiator 4. The amount of differentiation by this differentiator 4 changes in association with the length of the drain line similarly to the first and second embodiments. The dif ferentiator 4 has its output end connected to an integrator 5 and an inverting integrator 6. The integrator 5 is provided as an input with a disenable signal DE1 which attains a low level in response to a rising of the output signal of the output buffer Ba. The inverting integrator 6 is provided as an input with a disenable signal DE2 which attains a low level in response to a falling of the output signal of the output buffer Ba. Furthermore, in the third embodiment, an adder 7 to add the output signals of the integrator 5 and the inverting integrator 6 is provided. The output signal of the adder 7 is input to the adder 2, from which the sum of the output signals of the output buffer Ba and the adder 7 is output onto the drain line Da. In the third embodiment, the differentiator 4, the integrator 5, the inverting integrator 6, the adder 7 and the adder 2 constitute a video correction signal generator.

Figure 7:
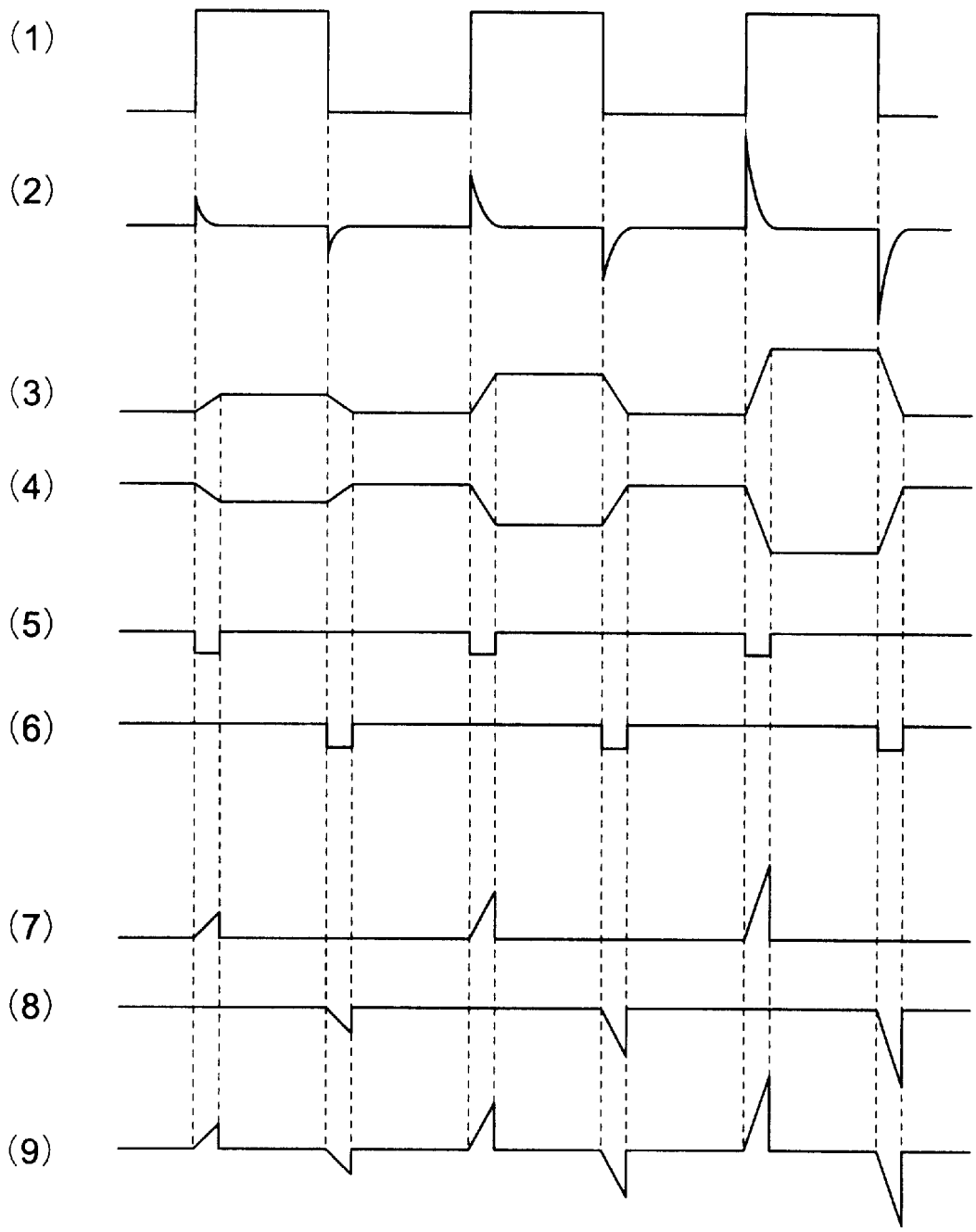
FIG. 7 is a timing chart for use in illustration of the operation of the liquid crystal display device according to the third embodiment of the present invention.

The operation of the liquid crystal display device according to the third embodiment having the above-described configuration will be now described. FIG. 7 is a timing chart for use in illustration of the operation of the liquid crystal display device according to the third embodiment of the present invention. Note that (1), (2), (5), (6), (7), (8) and (9) in FIG. 7 show waveforms at positions denoted by the same numerals in FIG. 6 and (3) and (4) in FIG. 7 show the waveforms of the output signals of the integrator 5 and the inverting integrator 6 when the disenable signals DE1 and DE2 are not input to them, respectively.

A signal input to the differentiator 4 from the output buffer Ba is differentiated by the differentiator 4 and output. The peak of the output signal of the differentiator 4 gradually increases as shown in FIG. 7 at (2).

When the output signal of the differentiator 4 is simply integrated, the waveform shown in FIG. 7 at (3) results, while when the output signal of the differentiator 4 is simply inverted and integrated, the waveform shown in FIG. 7 at (4) results. In the present embodiment, since the disenable signals DE1 and DE2 shown in FIG. 7 at (5) and (6) are input to the integrator 5 and the inverting integrator 6, the waveforms corresponding to the signals when the disenable signals attain a low level are output. These are the waveforms shown in FIG. 7 at (7) and (8).

The adder 7 takes the sum of the output signals of the integrator 5 and the inverting integrator 6, and therefore the signal having the waveform shown in FIG. 7 at (9) is output as the sum of the waveforms in FIG. 7 at (7) and (8).

Thereafter, the sum of this signal and the video signal at the output buffer Ba is output to the drain line Da from the adder 2. A signal having its peak gradually increased is superposed upon the video signal output at this time. As a result, the waveform is rounded by the resistance and capacitance parasitic in the drain line Da. However, a normal waveform results by the rounding about as much as the superposed amount when the signal reaches a thin film transistor connected to a prescribed gate line. Therefore, variations in video images can be prevented similarly to the first and second embodiments.

Figure 8A:
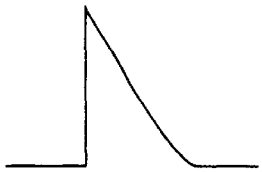
FIG. 8A is a schematic diagram of a signal to be superposed in the first embodiment.
Figure 8B:
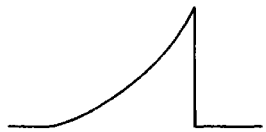
FIG. 8B is a schematic diagram of a signal to be superposed in the third embodiment.

The height of the peak of the signal superposed on the video signal in the third embodiment is lower than that of the signal superposed in the first and second embodiments. This is because the signal resulting from the differentiation is superposed as is in the first and second embodiments, while in the third embodiment, the sum of the integrated signal and the inverted and integrated signal is taken thereafter. FIG. 8A is a schematic diagram of a signal to be superposed in the first embodiment, and FIG. 8B is a schematic diagram of a signal to be superposed in the third embodiment. In the third embodiment, if the height of the peak is low, the effect of preventing image variations similar to the first embodiment results by allowing the peak portion to have almost the same area. Furthermore, if the height of the peak is thus low, the dynamic range of the adder does not have to be widen from the conventional range. Meanwhile, in the first embodiment, the dynamic range should be increased in some cases depending upon the height of the peak of the signal to be superposed, which requires another driver.

A fourth embodiment of the present invention will be now described. The fourth embodiment is achieved by combining the second and third embodiments. More specifically, a differentiator 4 shown in FIG. 6 instead of the differentiator 3 shown in FIG. 5, an integrator 5, an inverting integrator 6 and an adder 7 are provided. The differentiator 4 is provided as an input with a polarity inversion signal rather than the video signal from the output buffer.

According to the fourth embodiment having this configuration, not only the effect of preventing video image variations, but also provided are the effect of saving the occupied area according to the second embodiment and the effect of not having to expand the dynamic range according to the third embodiment.

Figure 9:
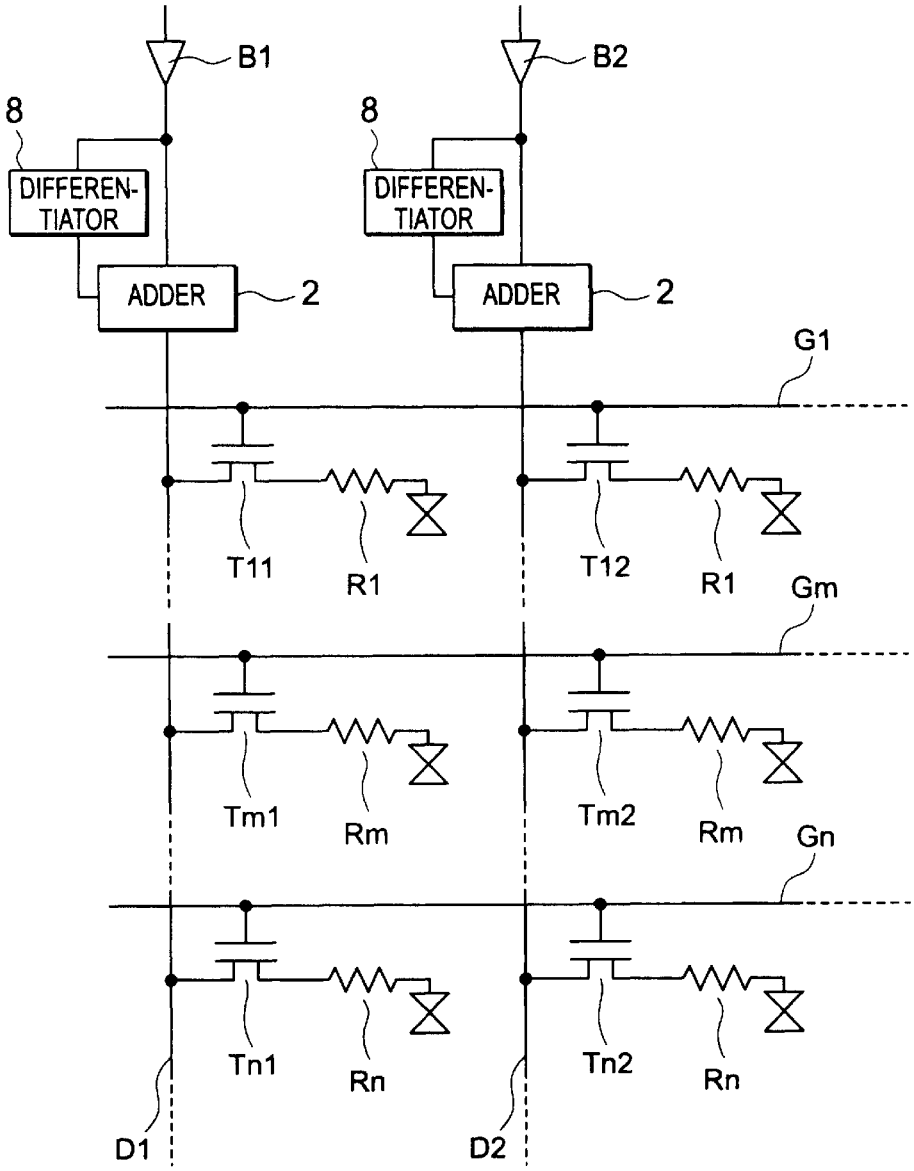
FIG. 9 is a block diagram of the configuration of a liquid crystal display device according to a fifth embodiment of the present invention.

A fifth embodiment of the present invention will be now described. In the first to fourth embodiments described above, a different signal is superposed on the video signal for each gate line, but in the fifth embodiment, a previously superposed, large signal is adjusted before application to the liquid crystal. FIG. 9 is a block diagram of the configuration of a liquid crystal display device according to the fifth embodiment of the present invention. Note that in the fifth embodiment shown in FIG. 9, the elements the same as those in the first embodiment shown in FIG. 2 are denoted with the same reference characters and a detailed description thereof is not provided.

In the fifth embodiment, the outputs of output buffers B1, B2, . . . each branch, and a differentiator 8 is connected each between one of the branches and the adder 2. The differentiator 8 is used to differentiate an input signal in an equal amount to the case when a video signal is supplied to a pixel provided at the farthest position from the output buffer in the first embodiment.

A resistive element R1 is connected each between transistors T11, T12, . . . in the first row and the liquid crystals, and a resistive element Rm is connected each between transistors Tm1, Tm2, . . . in the m-th row and the liquid crystals. A resistive element Rn is connected each between transistors Tn1, Tn2, . . . in the n-th row and the liquid crystals. The resistance value of the resistive element RI is larger than that of the resistive element Rm, while the resistance value of the resistive element Rm is larger than that of the resistive element Rn. More specifically, a resistive element provided for a pixel having a larger drain line length to the output buffers B1, B2, is set to have a smaller resistance value. In the fifth embodiment, the differentiator 8 and the adder 2 constitute a video correction signal generator.

Figure 1:
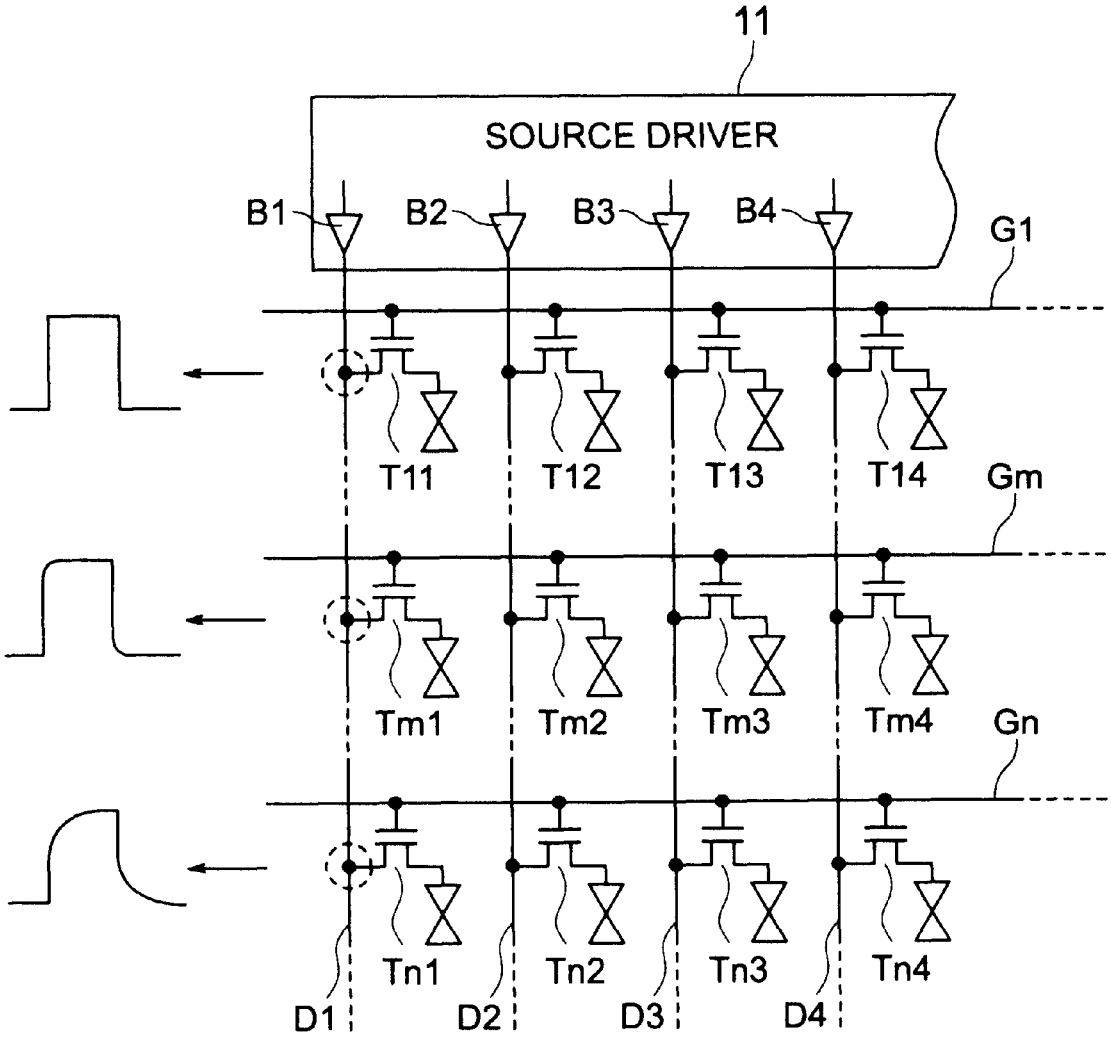
FIG. 1 (PRIOR ART)
FIG. 1 is a circuit diagram of the configuration of a conventional liquid crystal device.
Figure 10:
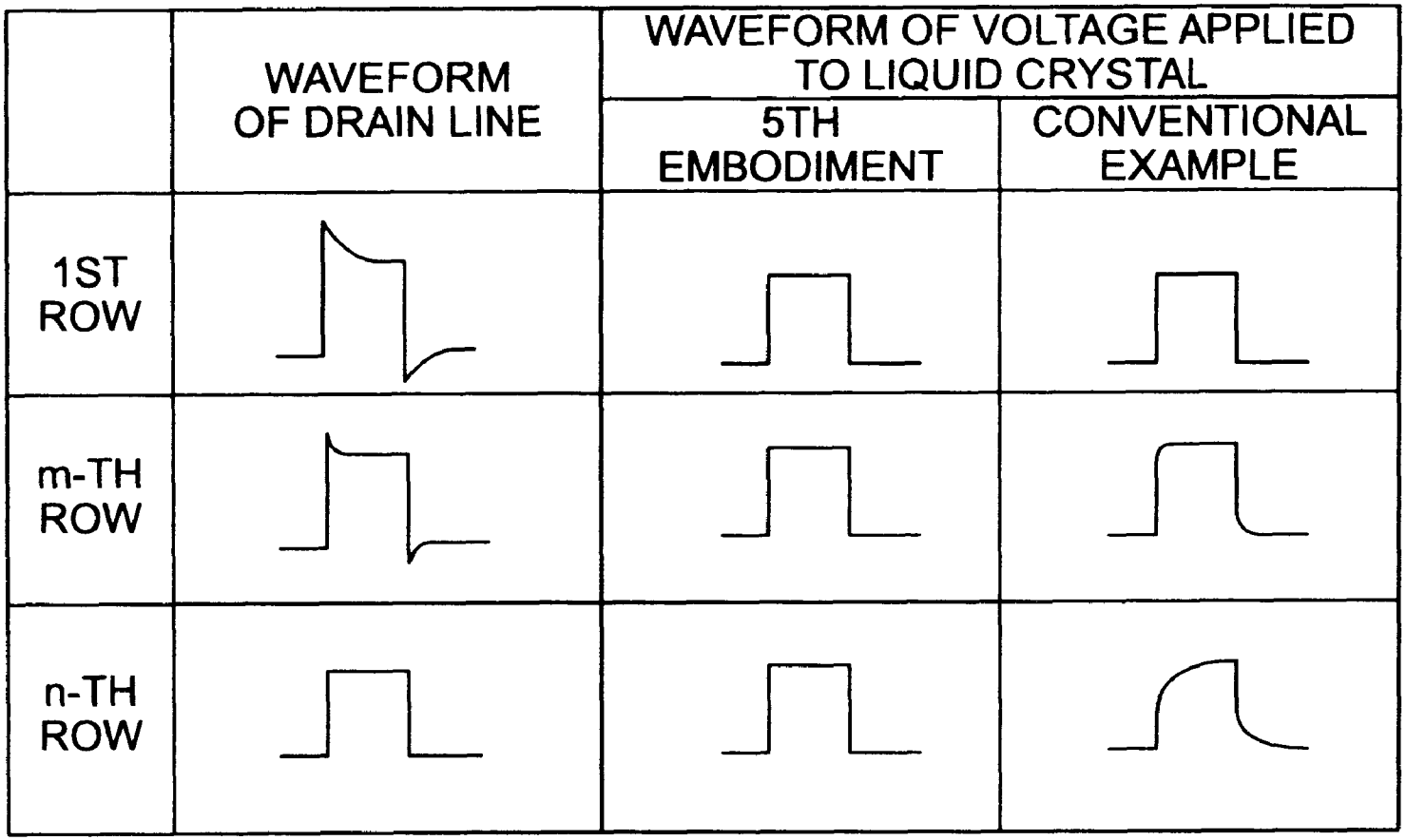
FIG. 10 is a table of waveforms for use in illustration of the operation of the liquid crystal display device according to the fifth embodiment of the present invention.

The operation of the liquid crystal display device according to the fifth embodiment having the above configuration will be now described. FIG. 10 is a table of waveforms for use in illustration of the operation of the liquid crystal display device according to the fifth embodiment of the present invention. Note that in FIG. 10, waveforms in a drain line in the conventional liquid crystal display device shown in FIG. 1 are also included for the purpose of comparison.

A video signal is input to the output buffers B1, B2, . . . from a sample-hold circuit (not shown) and output therefrom. The video signal output from the output buffers B1, B2, . . . is input to the differentiator 8 and the adder 2. The signal input to the differentiator 8 is differentiated and input to the adder 2. The amount of differentiation at this time is preferably more or less such an amount not to be eliminated by waveform rounding when the video signal is supplied to the pixel the farthest from the output buffers B1, B2, . . . .

Then, the sum of the video signal at the output buffers B1, B2, . . . and the differentiation signal from the differentiator 8 is output to each drain line D1, D2, . . . . The output signal has its waveform more rounded as a function of the distance from the adder 2 as shown in FIG. 10, but the waveform will not be smaller than the original waveform because a differentiation signal is superposed.

Thus, in the present embodiment, the signal output to the thin film transistor has a waveform produced by superposing some signal on a normal waveform. When thin film transistors turn on by a control signal from the gate lines G1, . . . , Gm, . . . , Gn, the signal supplied to the drains of the thin film transistors is input to the resistive elements R1, . . . , Rm, . . . , Rn, rounded and then applied to the liquid crystal. At this time, the above-described relation is established among the resistive elements R1, Rm and Rn, and therefore the degree of the waveform rounding is larger for those closer to the adder 2. As a result, as shown in FIG. 10, voltage having a normal waveform is applied to the liquid crystal.

Thus, also in the fifth embodiment, the voltage applied to the liquid crystal has a desired waveform. As a result, video image variations may be prevented, and video images having a desired luminance may result regardless of the distance between the pixel and the output buffer.

A sixth embodiment of the present invention will be now described. The sixth embodiment is achieved by combining the second and fifth embodiments. More specifically, a differentiator 8 shown in FIG. 9 is provided instead of the differentiator 3 in FIG. 5. Instead of the video signal from the output buffer, a polarity inversion signal is input to the differentiator 8.

In the sixth embodiment having the above-described configuration, not only the effect of preventing video image variations, but also provided is the effect of saving the occupied area according to the second embodiment.

It should be noted that the signal to be superposed to the video signal output from the output buffer is not limited to the signal described above, but any signal to be superposed on account of waveform rounding in that the level of the video signal changes may be used. For example, a signal having a square waveform may be superposed.

Furthermore, the level of a supplied signal at the time of falling is stored at a pixel in the liquid crystal display device as described above. Therefore, if waveform rounding exists at the time of rising of the waveform, the effect of the present invention may still be provided as long as the signal level at the time of falling is a prescribed level.

Therefore, in the fifth and sixth embodiments, a resistive element is provided for each pixel, but part or all of the resistive elements may be omitted if the level of a signal is normal at the time of falling for all the pixels.

In addition, the adder and the differentiator may be provided either inside the source driver provided with the output buffer or outside, but they should be provided at least on the output side of the output buffer.

As in the foregoing, since a video correction signal generator to superpose a correction signal on the output signal of an output buffer is provided, even with waveform rounding caused by resistance and capacitance parasitic in a drain line, the wave height of a video signal supplied to a desired pixel at the time of falling may be appropriately adjusted. As a result, video image variations may be prevented.

Furthermore, if a resistive element of a prescribed resistance value is connected in series to the source of a thin film transistor forming a pixel so that even with a large video signal input to the pixel, voltage to be applied to the liquid crystal may be appropriately adjusted.

In addition, the differentiator provided in the video correction signal generator allows a signal having an appropriate peak in at least one of the rising and falling of the output signal of the output buffer or a reference pulse signal to be generated. If the dif ferentiator is shared among drain lines, the area occupied by the circuit may be reduced.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A liquid crystal display device, comprising:

a plurality of pixels arranged in a matrix;

a drain line provided for each column of said plurality of pixels;

a gate line provided for each row of said plurality of pixels;

an output buffer to output a video signal to be supplied to said drain line; and a video correction signal generator to superpose a correction signal on the output signal of said output buffer wherein said correction signal varies in accordance with a length of said drain line to each pixel.

2. The liquid crystal display device according to claim 1, wherein said video correction signal generator superposes said correction signal on the output signal of said output buffer at least in one of the rising and falling of the output signal.

3. The liquid crystal display device according to claim 1, wherein said video correction signal generator changes a waveform of said correction signal in synchronization with the timing in which said gate line is driven.

4. The liquid crystal display device according to claim 1, wherein said video correction signal generator includes a differentiator to differentiate the output signal of each said output buffer, and an adder to add the output signal of each said differentiator and the output signal of each said output buffer, and said video correction signal generator outputs the output signal of each said adder to a corresponding one of said drain lines.

5. The liquid crystal display device according to claim 4, wherein said differentiator includes a shift register, and a potential switching system to switch a potential at an output end in association with the output signal of said shift register.

6. The liquid crystal display device according to claim 1, wherein said video correction signal generator includes a differentiator to differentiate an externally input reference pulse, and an adder to add the output signal of the differentiator and the output signal of each said output buffer, and said video correction signal generator outputs the output signal of each said adder to a corresponding one of said drain lines.

7. The liquid crystal display device according to claim 1, wherein said video signal correction signal generator includes a correction signal changing system to change a waveform of said correction signal in association with the length of said drain line between a pixel to be supplied with said video signal and itself.

8. The liquid crystal display device according to claim 7, wherein said video correction signal generator includes:

a differentiator to differentiate the output signal of said output buffer;

an integrator to integrate the output signal of said differentiator and output the result of integration in association with an input first disenable signal an inverting integrator to invert and integrate the output signal of said differentiator and output the result of integration in association with an input second disenable signal;

a first adder to add the output signal of said integrator and the output signal of said inverting integrator; and a second adder to add the output signal of said first adder and the output signal of said output buffer.

9. The liquid crystal display device according to claim 7, wherein said video correction signal generator includes:

a differentiator to differentiate an externally input reference pulse;

an integrator to integrate the output signal of said differentiator and output the result of integration in association with an input first disenable signal;

an inverting integrator to invert and integrate the output signal of said differentiator and output the result of integration in association with an input second disenable signal;

a first adder to add the output signal of said integrator and the output signal of said inverting integrator; and a second adder to add the output signal of said first adder and the output signal of said output buffer.

10. The liquid crystal display device according to claim 1, wherein said video correction signal generator includes:

a differentiator to differentiate the output signal of said output buffer;

an integrator to integrate the output signal of said differentiator and output the result of integration in association with an input first disenable signal;

an inverting integrator to invert and integrate the output signal of said differentiator and output the result of integration in association with an input second disenable signal;

a first adder to add the output signal of said integrator and the output signal of said inverting integrator; and a second adder to add the output signal of said first adder and the output signal of said output buffer.

11. The liquid crystal display device according to claim 1, wherein said video correction signal generator includes:

a differentiator to differentiate an externally input reference pulse;

an integrator to integrate the output signal of said differentiator and output the result of integration in association with an input first disenable signal;

an inverting integrator to invert and integrate the output signal of said differentiator and output the result of the integration in association with an input second disenable signal;

a first adder to add the output signal of said integrator and the output signal of said inverting integrator; and a second adder to add the output signal of said first adder and the output signal of said output buffer.

12. The liquid crystal display device of claim 1, wherein a different correction signal is superposed on said output signal for each gate line in accordance with a length of said drain line corresponding to a position of said each gate line.

* * * * *